US005592139A

United States Patent [19]

Trayer et al.

[11] Patent Number: 5,592,139

[45] Date of Patent: Jan. 7, 1997

[54] AIR-CONVECTION-COOLED DRY WELL FOR HIGH-VOLTAGE CURRENT-LIMITING FUSE FOR USE IN LIQUID OR GAS INSULATED SWITCHGEAR

[76] Inventors: Frank C. Trayer; John P. Trayer, both of 898 Pennsylvania Ave., San Francisco, Calif. 94107

[21] Appl. No.: 453,250

[22] Filed: May 30, 1995

[51] Int. Cl.[6] ..... H01H 85/02

[52] U.S. Cl. ..... 337/202; 337/204; 337/4

[58] Field of Search ..... 337/186, 4, 202–205, 337/194, 197; 200/149 A; 339/126 R, 126 RS, 255 RT

[56] References Cited

U.S. PATENT DOCUMENTS

| | | | |
|---|---|---|---|
| 3,829,810 | 8/1974 | Giegerich | 337/202 |
| 4,010,437 | 3/1977 | Macemon et al. | 337/204 |
| 4,012,708 | 3/1977 | Goe, Jr. | 337/205 |
| 4,275,372 | 6/1981 | Eley | 337/4 |
| 4,365,277 | 12/1982 | Trayer | 337/202 |
| 5,227,758 | 7/1993 | Ranjan | 337/202 |

*Primary Examiner*—Leo P. Picard
*Assistant Examiner*—Jayprakash N. Gandhi
*Attorney, Agent, or Firm*—Schapp and Hatch

[57] ABSTRACT

Methods and apparatus for fusing high-voltage electrical systems including fuse holding dry wells each of which includes a metallic outer wall, a fuse mount and a chimney tube located between the outer wall and a fuse in the mount. The dry wells may be mounted completely within an associated switchgear tank, partially within and partially without the associated tank, on the outer surface of the tank, or on structural means other than a switchgear tank.

7 Claims, 3 Drawing Sheets

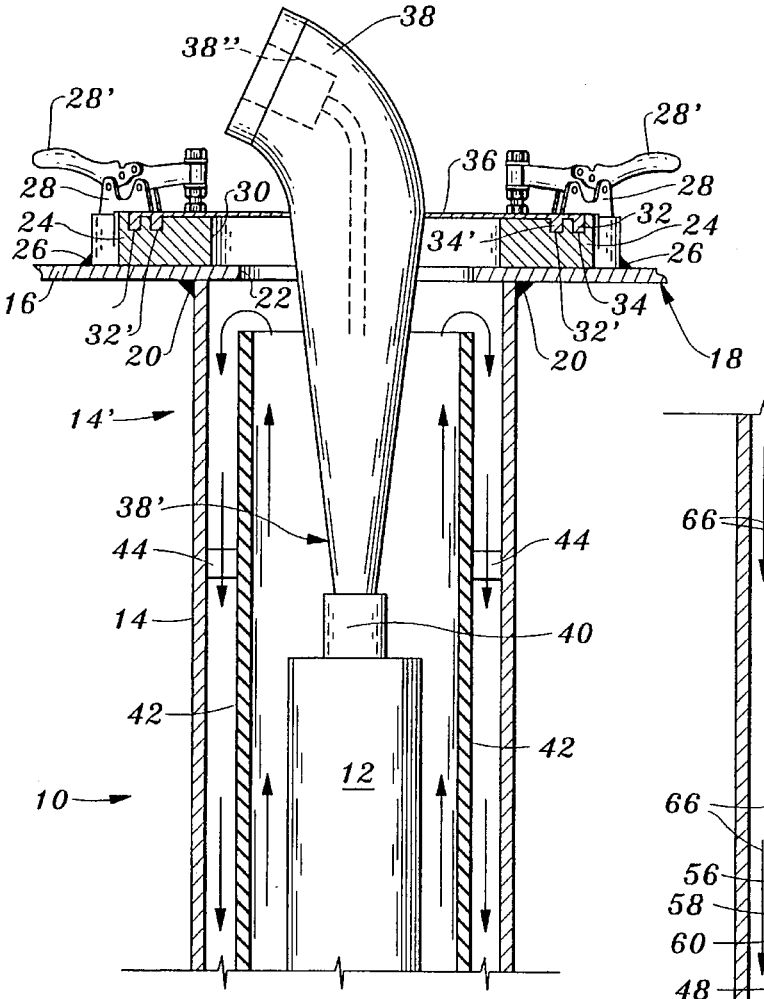
Fig. 1A
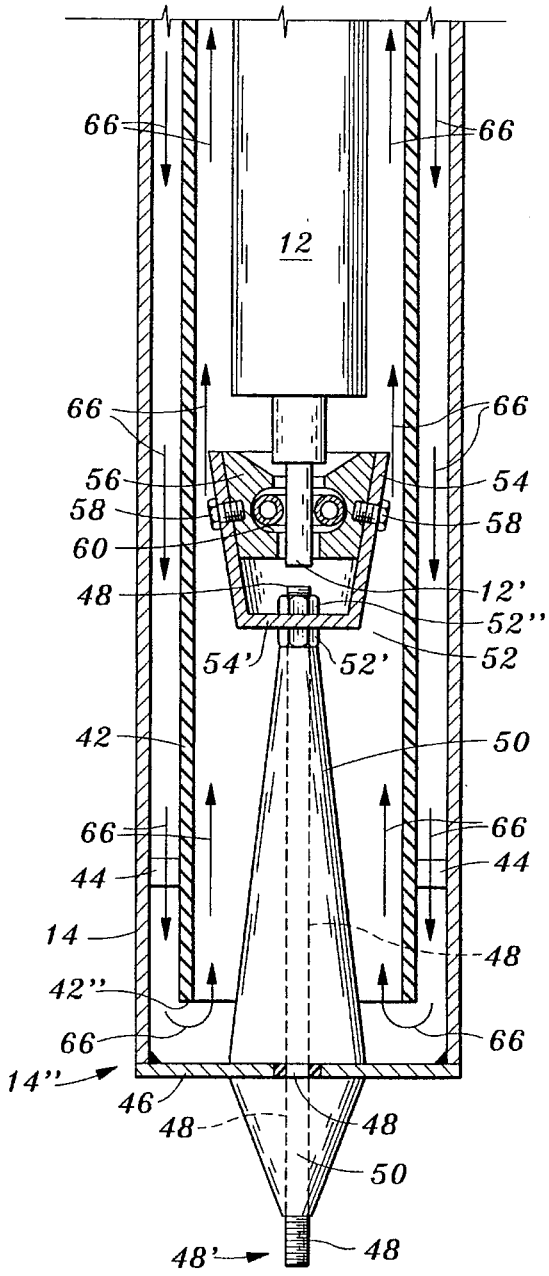
Fig. 1B
Fig. 1
| |
|---|
| Fig. 1A |
| Fig. 1B |

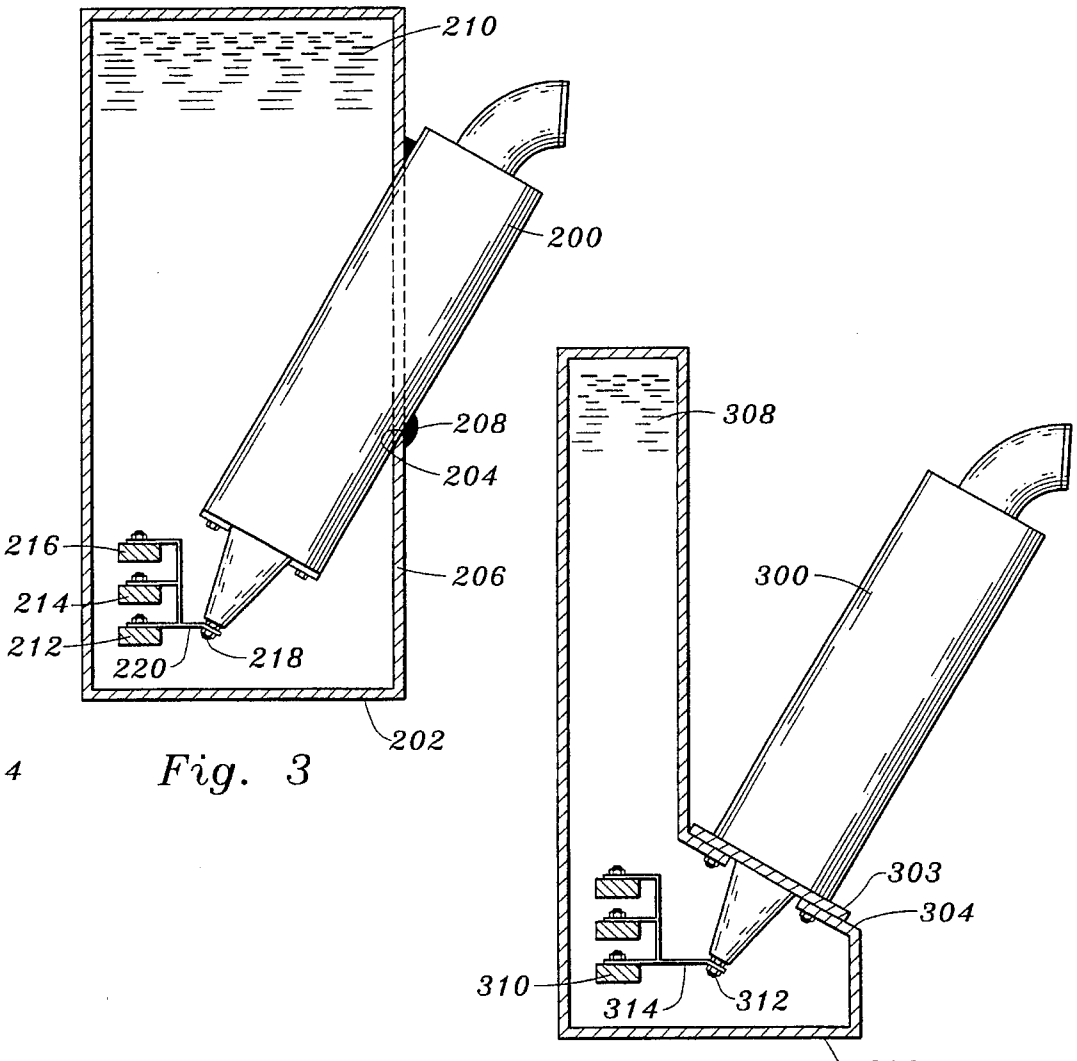
Fig. 3
Fig. 4
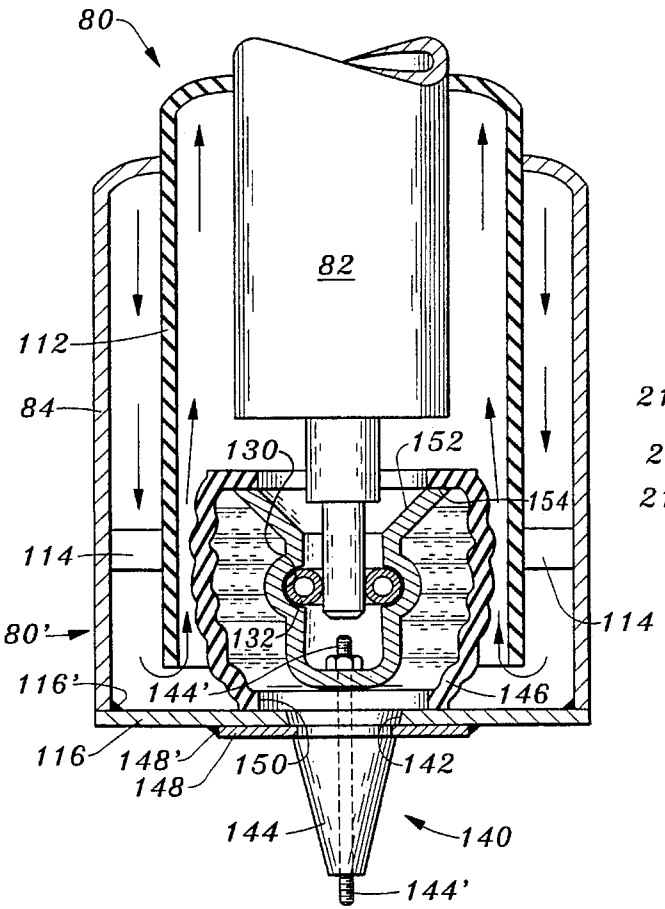
Fig. 2

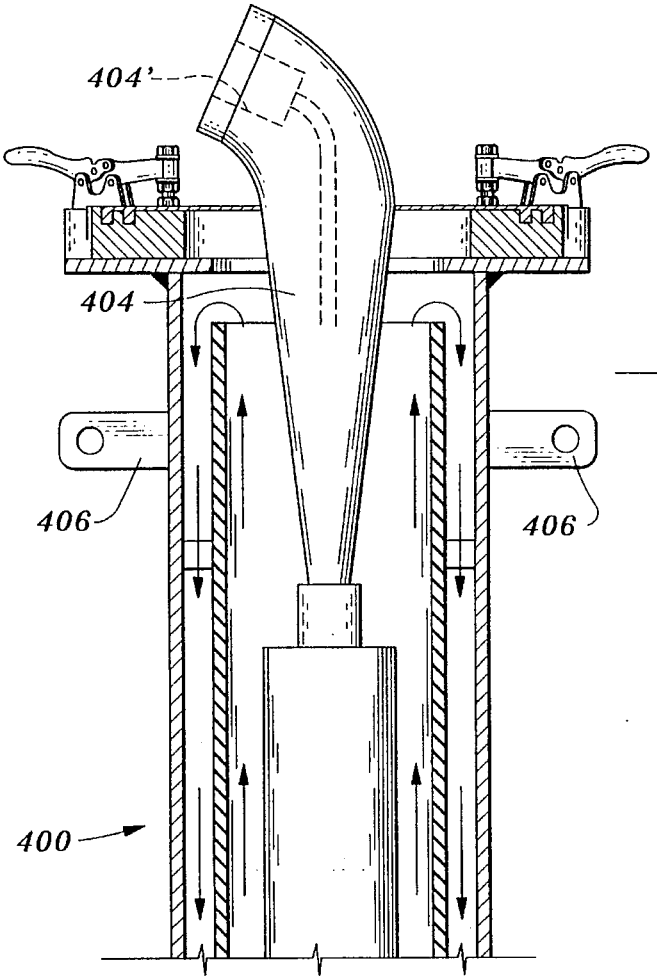
Fig. 5A
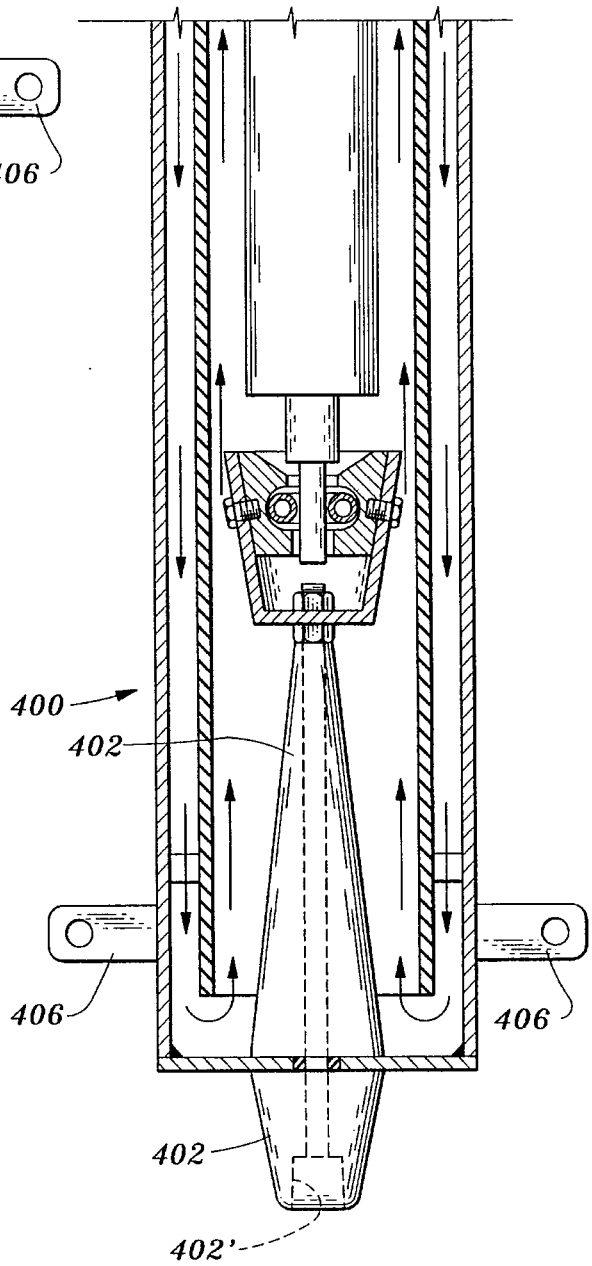
Fig. 5B
Fig. 5
| |
|---|
| Fig. 5A |
| Fig. 5B |

AIR-CONVECTION-COOLED DRY WELL FOR HIGH-VOLTAGE CURRENT-LIMITING FUSE FOR USE IN LIQUID OR GAS INSULATED SWITCHGEAR

BACKGROUND OF THE INVENTION

1. Field of the Invention

The present invention relates to high-voltage electrical switchgear, and more particularly to mounting means for mounting high-voltage current-limiting fuses in or on the enclosures of liquid or gas insulated switchgear.

2. Description of the Prior Art

The term "prior art" as used herein or in any statement made by or on behalf of applicants means only that any document or thing referred to as prior art bears, directly or inferentially, a date which is earlier than the effective filing date hereof.

A fuse holder which may be applied to various kinds of transformers, particularly distribution transformers, and which permits an air-type fuse to be mounted in the enclosure of such a transformer, and within the body of insulating oil contained therein, is shown and described in U.S. Pat. No. 4,010,437, which was issued to Herbert J. Macemon, et al, on Mar. 1, 1977, and entitled FUSE HOLDERS FOR TRANSFORMERS.

This U.S. Pat. (No. 4,010,437) will hereinafter be referred to as "Macemon".

Macemon nowhere teaches the cooling of air-type fuse 43 by a current of air circulating within fuse housing 22 thereof.

As seen in FIG. 1 of Macemon, the axis of fuse housing 22 of Macemon makes a small angle with respect to the surface of oil bath 13 of Macemon.

It is taught in Macemon that the outer end of housing 22 passes through an aperture in "the transformer front wall" 14.

It is stated in Macemon that housing 22 is "fabricated of an insulative material such as a glass fiber reinforced epoxy".

Macemon nowhere teaches the provision of a flow director tube or "chimney" tube located between housing 22 and fuse 43.

Macemon does not teach the substitution of a metallic housing for insulative housing 22, nor the provision of a "chimney" tube between fuse 43 and housing 22, nor the mounting of the outer end of housing 22 in an aperture in the top of housing 22.

No representation or admission is made that Macemon is part of the prior art, or that a search has been made, or that no more pertinent information exists.

A copy of Macemon is supplied to the United States Patent and Trademark Office herewith.

SUMMARY OF THE INVENTION

Accordingly, it is an object of the present invention to provide novel methods and apparatus for mounting a high-voltage current-limiting fuse for the protection of electrical equipment contained in a liquid-insulated or gas-insulated tank in or on said tank, and for replacing said fuse without releasing gas or exposing liquid to the environment outside said tank.

Another object of the present invention is to provide novel methods and apparatus for thus mounting high-voltage current-limiting fuses, by means of which methods and apparatus the advantages of the Macemon fuse holder may be had in gas-insulated switchgear as well as in liquid-insulated switchgear.

Yet another object of the present invention is to provide novel methods and apparatus for mounting a high-voltage current-limiting fuse in or on a liquid-insulated or gas-insulated switchgear tank, which methods and apparatus make available most or all of the advantages of the Macemon fuse holder and at the same time provide more efficient cooling of the fuse.

A further object of the present invention is to provide apparatus for mounting a high-voltage current-limiting fuse in or on a liquid-insulated or gas-insulated switchgear tank, which apparatus is not limited to the employment of 50 ampere maximum current rated fuses in 15-kilovolt systems, or 100 ampere maximum current rated fuses in 4.3-kilovolt systems, as is the Macemon fuse holder.

A yet further object of the present invention is to provide apparatus for mounting a high-voltage current-limiting fuse in or on a liquid-insulated or gas-insulated switchgear tank, the overall length of which apparatus is reduced by recessing the bayonet-type inner fuse contact into a novel insulating bushing.

It is another object of the present invention to provide novel apparatus for mounting a high-voltage current-limiting fuse either completely inside or almost completely outside the switchgear tank or enclosure with which it is associated.

Yet another object of the present invention is to provide novel apparatus for mounting a high-voltage current-limiting fuse in or on a liquid-insulated or gas-insulated switchgear tank, which novel apparatus permits a considerable reduction in the tank size of particular switchgear, thus reducing the necessary volume of insulating gas or fluid of a particular switchgear installation, reducing the weight of the liquid-insulated switchgear of particular installations, and eliminating welding, since the bottom bushing and the metal tank of certain particular switchgear installations can be bolted and gasketed.

It is a yet further object of the present invention to provide novel apparatus for mounting high-voltage current-limiting fuses the cylindrical outer walls of which can be fabricated from stainless steel or corrosion resistant aluminum alloy, if desired.

Other objects of the present invention will in part be obvious, and will in part appear hereinafter.

The present invention, accordingly, comprises the several steps and the relations of one or more of such steps with respect to each of the steps, and the apparatus embodying features of construction, combinations of elements, and arrangements of parts which are adapted to effect such steps, all as exemplified in the following disclosure, and the scope of the present invention will be indicated in the claims appended hereto.

In accordance with a principal feature of the present invention a high-voltage current-limiting fuse mounted in a dry well of the present invention is cooled by air convection.

In accordance with another principal feature of the present invention at least a part of the outer outer wall of a dry well of the present invention is formed from thermally conductive material, such as steel or aluminum.

In accordance with yet another principal feature of the present invention a dry well of the present invention includes a tubular air flow path defining member, or "chimney", which is located within and spaced from said outer wall and is fabricated from electrically insulating material.

In accordance with a further principal feature of the present invention a dry well of the present invention further includes fuse mounting means for mounting a high-voltage current-limiting fuse within said chimney and spaced therefrom.

In accordance with a yet further principal feature of the present invention a dry well of the present invention further includes dry well mounting means for mounting said dry well in an aperture in the wall of a switchgear tank, on a wall of a switchgear tank or on support means other than a switchgear tank.

In accordance with another principal feature of the present invention the dry well mounting means of certain embodiments include sealing means for fluid-tightly sealing the outer end of the dry well into an aperture in the wall of a switchgear tank.

In accordance with yet another principal feature of the present invention the outer end of a dry well of the present invention is provided with closure means for completely closing the outer end of the dry well.

In accordance with a further principal feature of the present invention the outer end closure means for closing the outer end of said dry well of the present invention includes removable cover means for completely covering an aperture in the outer end closure means, which aperture is sufficiently large so that a high-voltage current-limiting fuse which is to be mounted in said fuse mounting means can pass through said aperture.

In accordance with a yet further principal feature of the present invention said removable cover means includes a fuse bushing which passes therethrough and is fluid-tightly sealed therein.

In accordance with another principal feature of the present invention a fuse mount and connector is affixed to the inner end of the conductor of said fuse bushing.

In accordance with yet another principal feature of the present invention the inner end of a dry well of the present invention is provided with inner end closure means which is fluid-tightly sealed to the outer wall of the dry well, and a bushing (sometimes called the "inner bushing") is mounted and fluid-tightly sealed in an aperture in said inner end closure.

In accordance with a further principal feature of the present invention the conductor of said inner bushing is provided with a bayonet contact for receiving one ferrule of a fuse which is to be mounted in said dry well of the present invention.

In accordance with a yet further principal feature of the present invention said removable cover means is provided with fastening means whereby said removable cover means can be fastened to said outer end closure means in fluid-tight relation to the aperture therein.

In accordance with another principal feature of the present invention the inner end of the conductor of said outer bushing, which bushing is mounted in said removable cover means, is provided with contacting and fastening means for fastening one ferrule of a fuse which is to be mounted in said dry well of the present invention to said outer bushing conductor.

In accordance with yet another principal feature of the present invention said inner and outer bushings are so constructed and arranged as to permit recirculating air flow through the interior of said chimney tube and the space between the outer wall of said dry well of the present invention and said chimney tube.

In accordance with a further principal feature of the present invention said bayonet contact is contained within said inner electrical bushing.

In accordance with a further principal feature of the present invention said dry well of the present invention may be adapted for use in connection with a gas-insulated switchgear tank.

In accordance with another principal feature of the present invention said dry well of the present invention may be adapted for use in connection with a liquid-insulated switchgear tank.

In accordance with yet another principal feature of the present invention said dry well of the present invention may be adapted for use in connection with either a liquid-insulated switchgear tank or a gas-insulated switchgear tank.

In accordance with a further principal feature of the present invention a dry well of the present invention may be adapted to be substantially entirely operably contained within a switchgear tank, with its outer electrical bushing passing through the top wall of that switchgear tank.

In accordance with another principal feature of the present invention a dry well of the present invention may be adapted to be substantially entirely located outside of a switchgear tank with which it is operatively associated, or to be located remotely from said switchgear tank.

In accordance with yet another principal feature of the present invention a dry well of the present invention may be adapted to be so mounted in a wall of a switchgear tank with which it is operatively associated that a part of the dry well is located within the tank and another part of the dry well is located outside the tank.

In accordance with a further principal feature of the present invention the metallic outer wall of the dry well of a particular embodiment of the present invention is colored black or dark gray, or at least the inner face thereof.

In accordance with a yet further principal feature of the present invention the dry well mountings of certain preferred embodiments of the present invention may be so constructed and arranged that the axes of their associated dry wells, when mounted in switchgear tanks, are maintained at angles with respect to the vertical of 30° or more.

For a fuller understanding of the nature and objects of the present invention, reference should be had to the following detailed description, taken in connection with the accompanying drawings.

BRIEF DESCRIPTION OF THE DRAWINGS

FIGS. 1, 1A and 1B together constitute an elevational view, partly in section, of a dry well of the first preferred embodiment of the present invention;

FIG. 2 is a partial elevational view, partly in section, of a dry well of the second preferred embodiment of the present invention;

FIG. 3 is an elevational sectional view of a switchgear tank in which a dry well of the present invention is mounted in accordance with a second preferred embodiment of the present invention;

FIG. 4 is an elevational cross-sectional view of a switchgear tank on which a dry well of the present invention is mounted in accordance with a third preferred embodiment of the present invention; and FIG. 5, 5A and 5B together constitute an elevational view, partly in section, of a fourth preferred embodiment of the present invention.

DESCRIPTION OF THE PREFERRED EMBODIMENTS

Referring now to FIGS. 1, 1A and 1B, taken together, there is shown a dry well 10 of the first preferred embodiment of the present invention in which is mounted a high-voltage current-limiting fuse 12, such as a Combined Technologies X-limiter #155F100 fuse, rated at 100 amperes, 15 kilovolts.

The proper juxtaposition of FIGS. 1A and 1B is shown in FIG. 1.

As seen in FIGS. 1A and 1B, dry well 10 of the first preferred embodiment of the present invention is comprised of a steel cylinder 14 which serves as the outer wall of dry well 10.

It is to be noted that the end 14' of steel cylinder or outer wall 14, which is shown in FIG. 1A, is hereinafter sometimes referred to as the "outer end" of steel cylinder or outer wall 14; and that the end 14" of steel cylinder or outer wall 14, which is shown in FIG. 1B, is hereinafter sometimes referred to as the "inner end" of steel cylinder or outer wall 14. The reference numeral 14' is sometimes taken herein to designate the outer end of dry well 10, and the reference numeral 14" is sometimes taken herein to designate the inner end of dry well 10.

As seen in FIG. 1A, outer end 14' of steel cylinder 14 is affixed to the upper wall or top plate 16 of an electrical equipment tank 18 by means of weld bead 20.

An aperture 22 passes through top plate 16 of tank 18 within the area thereof which is surrounded by weld bead 20. Aperture 22 is sufficiently large in diameter so that fuse 12 can freely and completely be passed therethrough.

A steel ring 24 is affixed to tank top plate 16 by means of weld bead 26.

It is to be understood that both weld beads 20, 26 are continuous, closed circular weld beads which provide air-tight joints between the members which they respectively join. It is to be understood, then, that steel cylinder 14 is air-tightly joined to tank top plate 16, and that ring 24 is air-tightly joined to tank top plate 16.

As also seen in FIG. 1A, the axis of ring 24 substantially coincides with the axis of aperture 22.

The axis of central aperture 30 of ring 24 is substantially coincident with the axis of aperture 22 in tank top plate 16.

A set of three toggle clamps 28 are affixed to the upper surface of tank top plate 16 in a circular array the axis of which is substantially coincident with the axis of aperture 22. Toggle clamps suitable to be used as toggle clamps 28 are well known to those having ordinary skill in the art, and are shown and described in U.S. Pat. No. 4,170,000, issued to Frank C. Trayer on Oct. 2, 1979.

As further seen in FIG. 1A, two grooves 32, 32' are provided-in the upper face of ring 24, and gaskets 34, 34' are tight-fittingly disposed in grooves 32, 32'.

As yet further seen in FIG. 1A, a flat, circular metal cap or lid 36 is clampingly engaged with gaskets 34, 34', and thus cap or lid 36 is air-tightly sealed to ring 24, which is itself air-tightly sealed to tank top plate 16.

It is to be understood that steel cylinder 14 is air-tightly sealed to tank top plate 16 by means of weld bead 20.

Referring again to FIG. 1A, it will be seen that a bushing well 38 is fixedly mounted in cap 36 and is air-tightly sealed therein in the well known manner.

Bushing well 38 may, for example, be a Colt A-30, thirty-degree elbow bushing well which is suitable to accommodate an Elastimold load break insert which will mate with an Elastimold load break elbow cable terminator. The thirty degree angle of the Colt A-30 bushing well 38 allows dry well 10 to be mounted at thirty degrees from the vertical, as shown in FIGS. 3 and 4, whereby the associated elbow connector can be pulled off horizontally.

In situations in which it is desirable to pull the connector off vertically, an Elastimold #K1601PC-T1 bushing may be substituted for elbow bushing well 38, and dry well 10 mounted vertically, rather than at thirty degrees from the vertical, e.g., passing through top plate 16.

As yet further seen in FIG. 1A, one end of fuse 12 is mechanically affixed and electrically connected to inner end 38' of elbow bushing well 38 by way of a coupler 40 of well known type.

As also seen in FIGS. 1A and 1B, a tubular air flow path defining member or chimney 42 is suspended between outer wall 14 and fuse 12 by means of support members 44, not all of which are shown in FIGS. 1A and 1B.

It is to be particularly noted that chimney 42 does not extend to tank top plate 16, but rather that there is a gap between the upper end of chinmey 42 and tank top plate 16, for reasons which will be described hereinafter.

It is also to be noted that chimney 42 is spaced from outer wall 14, and also spaced from fuse 12.

Referring now to FIG. 1B, it will be seen that the lower end 14" of steel cylinder or outer wall 14 is closed by means of a circular steel end plate 46 which is welded to the lower end of steel cylinder 14, as by arc welding.

It will also be seen in FIG. 1B that the conductor 48 of a bushing well 50 passes through an aperture in circular steel end plate 46, and is insulated from circular steel end plate 46.

Bushing 50 may be an Elastimold 600T1 bushing.

Thus, it will be seen by those having ordinary skill in the art, informed by the present disclosure, that bushing 50 is rigidly mounted in air-tight sealing relationship on end plate 46, which is itself affixed in the end of steel cylinder 14 in air-tight relation thereto.

As will now be understood by those having ordinary skill in the art, informed by the present disclosure, the interior of dry well 10 is fluid-tightly sealed and thus completely isolated from the rest of the interior of tank 18. In accordance with the present invention, tank 18 may be filled with insulating oil, sulphur hexafluoride or ambient air, and thus, as demonstrated in extensive tests of dry wells of the present invention, fuses rated at 100 amperes can be adequately cooled.

In the known manner, the lower or outer end 48' of bushing conductor 48 is threaded for the connection thereto of conductive straps or the like.

As seen in FIG. 1B, a bayonet connector 52 is affixed to the inner end of bushing conductor 48 by means of bolts 52', 52", or in another well known manner.

Bayonet connector 52 is comprised, in the well known manner, of a conductive cup 54, the floor 54' of which is provided with a central aperture for receiving bushing conductor 48.

A toroidal conductive member 56 is received in the open upper end of cup 54, and is retained therein by means of suitable bolts 58.

A groove 60 in the inner face of toroidal conductive member 56 contains a coil spring 62 which is maintained in toroidal configuration by means of groove 60.

As also seen in FIG. 1B, the ferrule 12' of fuse 12 is resiliently, tight-fittingly, received within toroidal coil spring 52, and thus a connection is made between bayonet connector 52 and ferrule 12' of fuse 12.

As will now be evident to those having ordinary skill in the art, informed by the present disclosure, a connection is maintained between the well 38" in the outer end of bushing 38 and the threaded outer end 48' of the conductor 48 of bushing 50, through the fusible member of fuse 12.

Referring again to FIG. 1B, it will be seen that the lower end 42" of chimney 42 does not extend to end plate 46, but rather is spaced from end plate 46.

Thus, it will be understood by those having ordinary skill in the art, informed by the present disclosure, that the heat generated by the fusing of the fusible member of fuse 12, and the consequent heating of the air contained in dry well 10, provides an intense convection current or air (shown by arrows 66) and thus transfers heat to steel cylinder 14. The heat transferred to steel cylinder 14 is then further transferred to the insulating medium (gas or liquid) contained in electrical equipment tank 18. By this means, which is a principal feature of the present invention, the effective rating of fuse 12 is considerably increased.

It has been empirically determined that the convective dissipation of fusing heat, and consequent increase in effective fuse rating, which is a principal feature of the present invention takes place to a substantial degree so long as the longitudinal axis of dry well 10 is directed no more than thirty degrees from the vertical.

It has also been determined, as part of the present invention, that the inner face of steel cylinder or outer wall 14 should be painted or otherwise coated black or dark gray for optimum results if cylinder 14 is fabricated from stainless steel.

It has also been determined that cylinder 14 should be nine inches or more in diameter to optimize the heat transferring effect of the structure of the invention.

Extensive testing of devices embodying the present invention has established that when the diameter of steel cylinder 14 is nine inches or more the dry well of the invention will have a voltage rating of 25 kilovolts to 125 kilovolts B.I.L., using a 5.375 inch inner diameter and 5.85 inch outer diameter G12 epoxy tube as chimney 42.

Referring now to FIG. 2, there is shown the inner end 80' of a dry well 80 of the present invention.

Dry well 80 differs from dry well 10 only in the particulars shown in FIG. 2 and described below in connection with FIG. 2.

The practice is adopted herein of designating the parts of dry well 80 (FIG. 2) corresponding to particular parts shown in FIGS. 1A and 1B by the reference numeral used in FIGS. 1A and 1B with the constant numerical value 70 added thereto. Thus, chimney 112 shown in FIG. 2 corresponds to chimney 42 shown in FIGS. 1A and 1B, and is substantially identical thereto. Similarly, fuse 82 shown in FIG. 2 corresponds to fuse 12 shown in FIGS. 1A and 1B, and is substantially identical thereto.

Referring again to FIG. 2, it will be seen that dry well 80 is comprised of a steel cylinder or outer wall 84, an insulating chimney 112, chimney supports 114, an inner end closure plate 116, etc., all of which parts are substantially identical to the corresponding parts of dry well 10.

A high-voltage current-limiting fuse 82 can be mounted in dry well 82 in substantially the same manner in which fuse 12 is mounted in dry well 10.

A bushing assembly 140 is mounted in an aperture 142 in inner end closure plate 116; Bushing assembly 140 is comprised of an outer bushing section 144 and an inner bushing section 146. Bushing assembly 140 is maintained in its operative position by means of a flange 148 which is welded to inner end closure plate 116.

Inner bushing section 146 and outer bushing section 144 are cemented together along interface 150 in air-tight relationship.

Inner bushing section 146 contains a conductive cup 152 which is adhered to inner bushing section 146 along interface 154. Conductive cup 152 is provided with a groove 130 which contains a toroidal coil spring 132 in which ferrule 82' of fuse 80 is tight-fittingly grasped. The inner end of bushing conductor 144' is electrically connected to cup 152 by means of a pair of nuts or the like.

It is to be understood that inner end closure plate 116 is air-tightly sealed to outer wall 84 by means of weld bead 116'.

Also, flange 148 is air-tightly sealed to inner end closure plate 116 by means of weld bead 148', and flange 148 is air-tightly sealed to outer bushing section 144.

Thus it will be seen by those having ordinary skill in the art, informed by the present disclosure, that inner end 80' of dry well 80 is air-tightly sealed.

It will also be evident to those having ordinary skill in the art, informed by the present disclosure, that bushing assembly 140, in which conductive cup 152 is located within inner bushing section 152, provides a means of reducing the overall length of dry well 80 as compared with dry well 10. Thus, it is to be understood that bushing assembly 140 constitutes a principal feature of the present invention.

Referring now to FIG. 3, there is shown a second preferred method of mounting a dry well 200 of the present invention in an electrically associated, oil-filled switchgear tank 202.

In accordance with this method of dry well mounting, which is a principal feature of the present invention, dry well 200 is mounted in an aperture 204 in a side wall 206 of tank 202, and is sealed therein by sealing means 208.

In the well known manner, tank 202 contains insulating oil 210 in which there is immersed a set of buss bars 212, 214, 216. The inner end of bushing conductor 218 of dry well 200 is connected to buss bar 212 by means of conductive strap 220.

It is to be particularly noted in FIG. 3 that dry well 200 is so located in tank side wall 206 that a substantial part of dry well 200 is located inside tank 202, and another substantial portion of dry well 200 is located outside tank 202.

This mounting arrangement (FIG. 3) is a principal feature of the present invention.

In accordance with another principal feature of the present invention, illustrated in FIG. 4, a dry well 300 is provided with an end flange 302 by means of which it is mounted on slanted face 304 of tank 306.

Tank 306 is filled with insulating oil 308.

Buss bar 310 (FIG. 4) is electrically connected to inner bushing conductor 312 of dry well 300 of the present invention by means of strap 314.

As will be evident to those having ordinary skill in the art, informed by the present disclosure, two additional dry wells may be mounted on slanted face 304 of tank 306, each of these two additional dry wells being connected, respectively, to one of the two additional buss bars 310', 310" by means of straps 314', 314", when the apparatus of FIG. 4 is incorporated in a three-phase electrical power system.

It is to be understood that each tank 202, 306 is illustrated schematically only in FIGS. 3 and 4, much of the apparatus contained therein, and a substantial part of each tank, being omitted for clarity of illustration.

Thus, it will be evident to those having ordinary skill in the art, informed by the present disclosure, that the switchgear associated with the buss bars in each tank 202, 306 has been omitted, and that the volume of each tank 202, 306, in actual practice, would be considerably larger than shown, by comparison with dry wells 200 and 300.

In accordance with another principal feature of the present invention dry well 300 is located substantially entirely outside of tank 306, but is affixed to tank 306.

It is to be understood that in accordance with the present invention any fuse well thereof may be mounted within, on, or partially within and partially without, its electrically associated tank.

Referring now to FIGS. 5, 5A and 5B, there is shown a dry well 400 of a fourth preferred embodiment of the present invention.

Dry well 400 differs from dry well 10 of the first preferred embodiment in the following particulars.

First, as seen in FIGS. 5A and 5B, both of the bushings 402, 404 thereof are bushing wells, adapted to operatively receive cooperating cable terminators in the well known manner.

Thus, bushing 402 is provided with a contact well 402' capable of receiving and retaining a terminator of an electrical cable, and bushing 404 is provided with a contact well 404' which is capable of receiving and retaining a terminator of a second associated electrical cable. Said second cable may extend from bushing well 402 to a bushing well in the wall of the associated tank, from which a strap extends to a buss located inside the tank.

Second, as seen in FIGS. 5, 5A and 5B, dry well 400 is also provided with a set of brackets 406 whereby dry well 400 may be mounted on a structure other than a switchgear tank, and thus located remotely from its electrically associated switchgear tank.

It will thus be understood by those having ordinary skill in the art, informed by the present disclosure, and particularly FIGS. 5, 5A and 5B, that the mounting of a dry well of the present invention remotely from its associated switchgear tank constitutes a feature of the present invention.

It is to be understood that particular conventional features of the dry wells of the present invention, such as bushings, bushing wells, mounting brackets, cover clamps, etc., are not limitative of the present invention, and that the substitution of other well known components therefor may be carried out by those having ordinary skill in the art without departing from the scope of the present invention.

It will thus be seen that the objects set forth above, among those made apparent from the preceding description, are efficiently attained, and since certain changes may be made in the above constructions and the methods carried out thereby without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

What is claimed is:

1. A dry well for a high-voltage current-limiting fuse, comprising:

a thermally conductive outer wall having a first open end and a second open end;

first closure means for said first open end, having an aperture passing therethrough which is of sufficient size to pass said fuse;

second closure means for said second open end;

cover means for covering said aperture;

fastening means for fastening said cover means in air-tight closing relation to said aperture;

first bushing means air-tightly mounted in said cover means and including a first bushing conductor passing through said cover means and insulated therefrom;

second bushing means air-tightly mounted in said second closure means and including a second bushing conductor passing therethrough and insulated therefrom;

first and second fuse mounting means affixed respectively to the adjacent ends of said first and second bushing conductors; and chimney means located within and spaced from said outer wall and first and second closure means and spaced from and surrounding said fuse when it is mounted in said fuse mounting means.

2. A dry well as claimed in claim 1, further comprising dry well mounting means for mounting said dry well in an opening in a wall of a switchgear tank.

3. A dry well as claimed in claim 2 in which said dry well mounting means is adapted for mounting said dry well in the top of said tank with the axis of said dry well substantially perpendicular to said top.

4. A dry well as claimed in claim 2 in which said dry well mounting means is adapted for mounting said dry well in a wall of said tank with the axis of said dry well forming an acute angle with said wall.

5. A dry well as claimed in claim 2 in which said dry well mounting means is adapted for mounting said dry well in a wall of said tank with the axis of said dry well perpendicular to said wall.

6. A dry well as claimed in claim 1, further comprising dry well mounting means for mounting said dry well on the outer surface of a wall of a switchgear tank.

7. A dry well as claimed in claim 1, further comprising dry well mounting means for mounting said dry well on a structure other than a switchgear tank.

* * * * *